US006761135B1

(12) United States Patent
Becktold

(10) Patent No.: US 6,761,135 B1
(45) Date of Patent: Jul. 13, 2004

(54) MULTIPURPOSE ASSEMBLY

(76) Inventor: Bryon Edward Becktold, 61626 Vankal, Mattawan, MI (US) 49071

( * ) Notice: Subject to any disclaimer, the term of this patent is extended or adjusted under 35 U.S.C. 154(b) by 0 days.

(21) Appl. No.: 10/649,181

(22) Filed: Aug. 27, 2003

(51) Int. Cl.[7] ..... F24D 3/10

(52) U.S. Cl. ..... 122/396; 392/473; 237/19; 237/80

(58) Field of Search ..... 122/396; 237/8 D, 237/8 A, 19, 80, 59, 69; 126/367; 392/473

(56) References Cited

U.S. PATENT DOCUMENTS 3,223,079 A * 12/1965 Walter et al. ..... 123/271.2 A
5,524,820 A * 6/1996 Regan ..... 237/19
5,838,880 A * 11/1998 Brooks et al. ..... 392/485
5,964,402 A 10/1999 Jakobson
6,325,297 B1 * 12/2001 Calvin et al. ..... 237/12.3 B
6,332,580 B1 * 12/2001 Enander et al. ..... 237/2 A
6,408,843 B1 6/2002 Bernard

OTHER PUBLICATIONS

Technical Data Sheet for HYDRO TEK SC PRO LINE Steam Cleaners & Pressure Washers.
Technical Data Sheet for HYDRO TEK SC30005 Steam Cleaners & Pressure Washers.
Operators Manual for HEAT KING HK500 Ground Heater.
Technical Data Sheet for HYDRO TEK SC DIESEL Hot/Cold/Steam Pressure Washer.

* cited by examiner

*Primary Examiner*—Gregory A. Wilson
(74) *Attorney, Agent, or Firm*—Joseph K. Andonian

(57) ABSTRACT

A combination capable of providing all of the functions of a ground heater and a pressure washer in a more economical, convenient and effective manner by employing and engine, as pump, a generator, a burner, a boiler, a water tank, a float tank, a ground heater hose and reel, and a pressure washer hose and reel all mounted on a skid or trailer.

13 Claims, 3 Drawing Sheets

MULTIPURPOSE ASSEMBLY

This invention relates to an improved assembly of components that collectively are capable of performing several functions including those of a pressure washer and a ground heater.

BACKGROUND OF THE INVENTION

Ground heaters are primarily used to heat frozen ground in preparation for laying concrete. They can also be used to accelerate the curing of concrete in cold weather. For such purposes they usually employ a pump, a heating system for water, a large water tank and a long hose stored on a reel and rely on an outside source of electrical power to operate. The hose is generally spread snake like over the ground or fresh concrete for thawing or curing. In temperate climates ground heaters can be used only during the winter months, usually as little as two months out of a year. Since they generally cost tens of thousands of dollars, they represent a very large investment for something that lays idle for most of the year. U.S. Pat. Nos. 5,964,402 and 6,408,843 disclose and claim an improved portable ground heating equipment or components thereof but do not address the desirability of increasing the versatility and economy of the dedicated equipment tied up in ground heaters.

Similarly pressure washers are primarily used for washing all sorts of surfaces, structures and equipment and, although they often lay idle for long periods of time, their usage is less limited by weather especially if they employ a heating system. The more sophisticated units can employ an engine, a pump, a generator, a heating system, a water tank of some sort and a relatively short hose with a pressure wand.

It is not uncommon for builders to transport and use both ground heaters and pressure washers of some type at the same building site at about the same time for their independent uses.

SUMMARY OF THE INVENTION

The present invention resulted from the astute observation that by combining some of the basic components of ground heaters and pressure washers in modified form the capabilities of both ground heaters and pressure washers could be retained and even improved. It was also observed that equipment with the capabilities of pressure washers and ground heaters are often useful to the same people under similar circumstances, especially by builders at building sites. Thus pumps, water and fuel tanks, heating systems and platforms or trailers are common to both. To the extent that the components differ they are compatible and, when optimized and used for both purposes, add to the utility and economy of each component as well as the combination. Thus pressure washers are inter alia useful to (1) wash buildings, cars, trucks, heavy equipment, buildings, decks, and surfaces of all kinds; (2) perform hydrostatic testing; (3) do sand blasting; (4) do water jet drain cleaning; and (5) clean industrial plants. Ground heaters can thaw frozen ground, cure concrete, act as temporary boilers; and, in combination with space heaters, heat buildings and/or rooms.

It is an object of this invention to provide one integrated assembly of components which will inter alia perform all of the functions of a pressure washer and a ground heater more economically, more effectively and more conveniently than the pressure washer and ground heater employed separately. It is also an object of this invention to provide equipment for use by builders on site year-round and not just for the cold two or three months of the year. It is a further object of this invention to make more efficient and extensive use of those parts of pressure washers and ground heaters that are common to both.

The foregoing objectives can be accomplished essentially by the addition of a ground heater hose and reel and a large water tank to the components of a pressure washer equipped with a heating system with sufficient capacity for use in a ground heater and preferably a positive displacement pump. In addition the controls, connections and platform on which the entire assembly is mounted are added in modified form to accommodate all of the functions and components of the resulting pressure washer/ground heater.

The ground heater function generally requires more hose and a correspondingly larger reel to store the hose than the pressure washer. Rather than use the same reel and hose for both pressure washer and ground heater uses, it has proven necessary to provide separate reels and hoses for each type of use. A ground heater hose must be capable of withstanding both the high temperatures required for ground heating and the additional abuse likely to be encountered by hose spread over the ground at a building site where mobile heavy equipment is commonplace and can accidentally run over the hose. Since long lengths of hose are often required for heating large ground areas, a large electrically powered reel is highly desirable to store, extend and retract the hose.

A much shorter hose capable of withstanding high pressures (e.g. 3000 psi compared to 150 psi for a ground heater) on a smaller, manually operated reel is generally acceptable for pressure washer use.

A large water tank is a necessity to fill a long ground heater hose and can be useful on occasion for pressure washer use. Likewise provision must be made in the construction of the combination to allow for the use of the combination for any of the basic uses of ground heaters and pressure washers. Thus the water must be capable of delivery to the ground heater hose separately and alternatively from the pressure washer hose. Although ground heater uses always require heated water containing antifreeze (e.g. propylene glycol), pressure washer uses may or may not employ heated water always without antifreeze. A float tank adapted for connection to an outside source of water is also a useful component for pressure washer use, especially during the winter when the main water tank contains antifreeze which is not suitable for pressure washer use. Special connections are required not only to facilitate separation of the two sources and types of water but also to accommodate the large variation in the pressure with which the water is delivered for the two separate uses.

An ordinary garden hose can be employed to connect the float tank to an outside source of water. The outlet from the float tank is connected to one inlet of a three way valve. The outlet from the main water tank is connected to the other inlet of the three way valve. The outlet from the three way valve is connected to the pump. The operator can thereby connect the pump to either source of water. The pump then forces the water through the water heater, preferably a water tube boiler, to an outlet to which either the ground heater hose or the pressure washer hose can be connected. A manual connection is preferred because presently available commercial valves would have difficulty handling the high pressures (e.g., 3000 psi) often employed for pressure washer use.

It is also highly desirable to splice a safety relief valve in the conduit between the pump and the boiler to prevent the lower pressure hose used for ground heating (e.g. 150 psi) from bursting in the event the ground heater hose is accidentally pinched or constricted. If that should happen the valve would simply prevent the water from reaching the boiler and would instead redirect the water back into the water tank.

The combination can also be modified so that the ground heater hose can be directed to a space heater to heat rooms or buildings at a building site after it has passed through the ground heating hose and before it returns to the storage tank. This increases the usefulness of the combination of the present invention at substantially no additional cost to heat a building or room.

A third small manually operated hose reel can advantageously be added to the combination of this invention to store, extend and retract an ordinary garden hose which can be connected to any outside source of water to fill the large storage tank, especially on site.

Ground heaters often require a separate source of electricity to power their pump and burner reducing their flexibility for use at sites where a power source is not available. The combination of this invention generates its own power and thereby avoids this problem. Since a ground heater is used to thaw frozen ground in winter months, it is necessary to use antifreeze in the water in appropriate concentrations for the temperature conditions encountered. Propylene glycol is the preferred antifreeze, especially since it is biodegradable and therefore environmentally friendly if spillage occurs for any reason.

Although individual components are optimized for combined use, the present invention essentially transforms components normally found in a pressure washer with a heating system into a ground heater/pressure washer by combining standard components of existing ground heaters, primarily ground heater hose and reel and a large water tank, to a modified pressure washer in a novel way on a suitable platform. Additional components and unique connections between the components complete the invention. Although a large holding tank for antifreeze containing water is most preferred for ground heater use, other liquids such as those containing detergents could be employed especially for pressure washer use.

LIST OF REFERENCE NUMERALS

Figure 1:
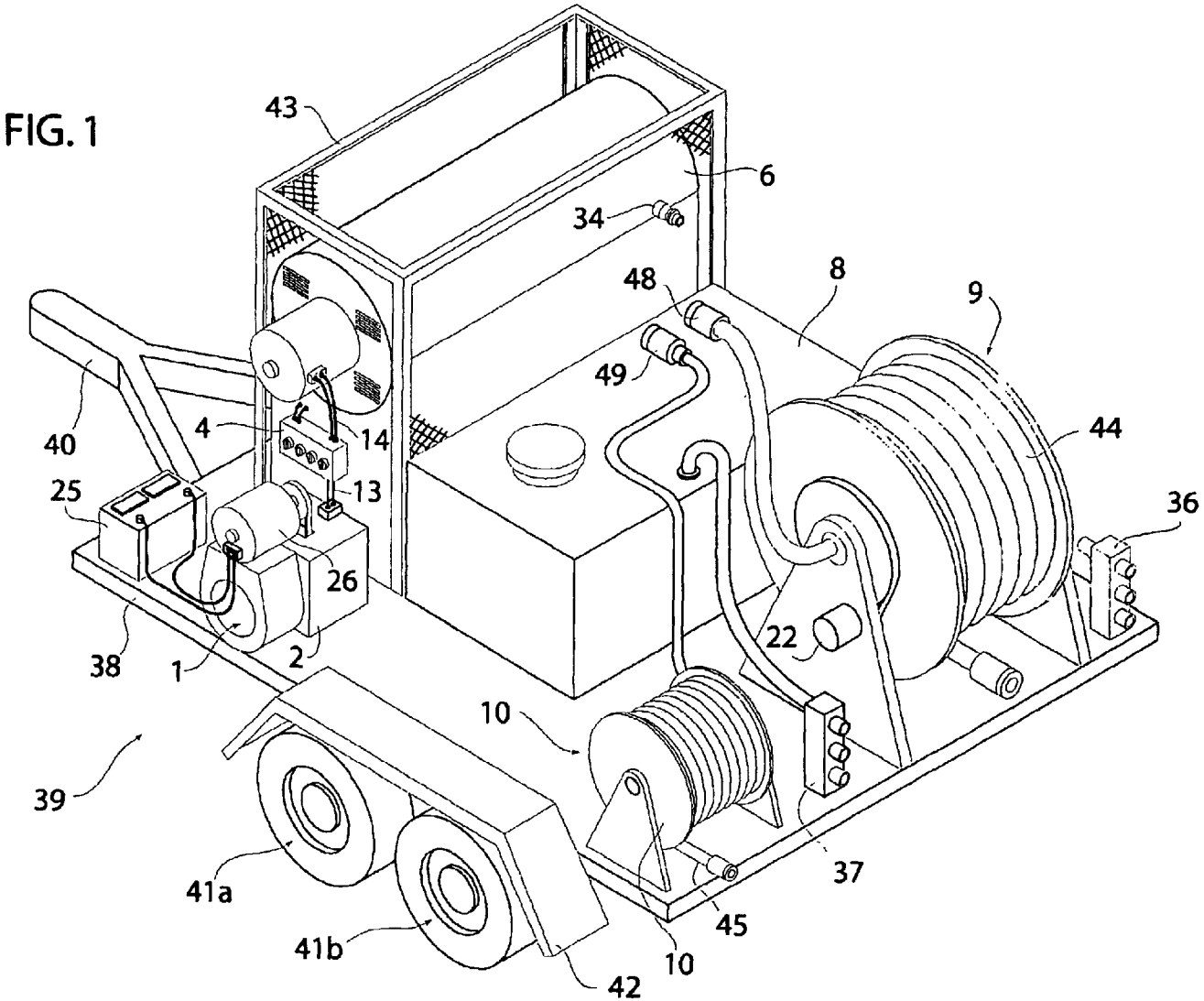
FIG. 1 is an isometric view of the invention mounted on a trailer.

1 Engine
2 Generator
3 Pump
4 Control panel
5 Burner
6 Boiler
7 Fuel tank
8 Water tank
9 Ground heater hose reel
10 Pressure washer hose reel
11 Space heater
12 Wand for high pressure hose
13 Electric wire from generator to control panel
15 Coils inside boiler
18 Relief valve
20 Optional hose from ground heater hose reel to space heater
21 Optional hose from space heater to ground heater hose reel
22 Electric motor for ground heater hose reel
23 Electric wire from control panel to ground heater motor
24 Electric wire from control panel to space heater
25 Battery
26 Starter
27 Engine shaft
28 Generator shaft
29 Pump shaft
30 Pump belt
31 Generator belt
32 Float tank
33 Three way ball valve
34 Male part of manual coupler
36 Ground heater outlet manifold
37 Ground heater inlet manifold
38 Trailer bed or skid
39 Trailer
40 Tongue
41*a* Trailer wheel with tire
41*b* Trailer wheel with tire
42 Fender
43 Cage
44 Ground heater hose
45 Pressure washer hose
46 Fuel line
47 Flexible tubing
48 Female part of coupler for ground heater hose
49 Female part of coupler for pressure washer hose

DETAILED DESCRIPTION

Figure 2:
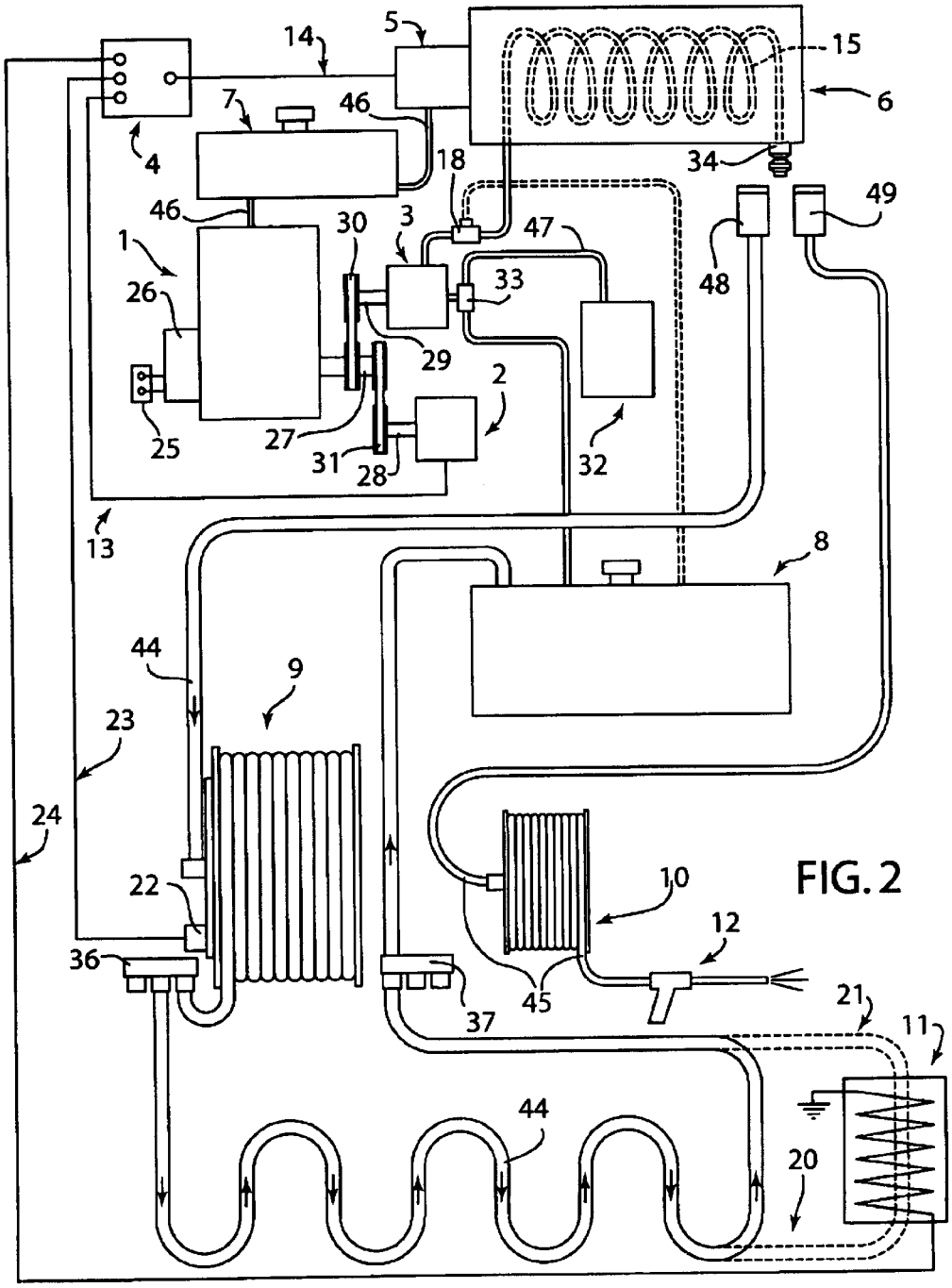
FIG. 2 is a block diagram that identifies the various components of the invention and discloses the manner in which they are connected to each other.
Figure 3:
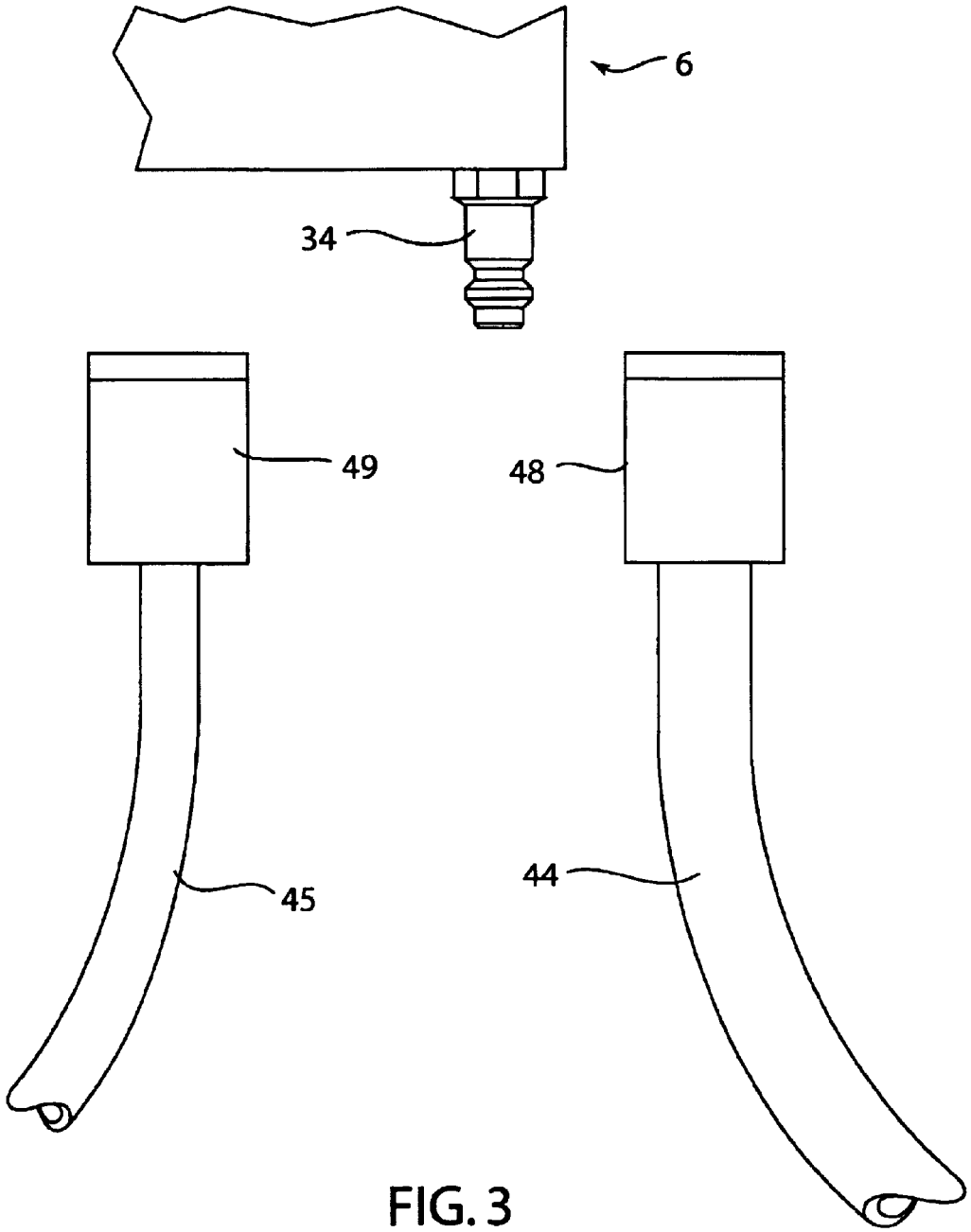
FIG. 3 is a view of the manual coupler including its male and female parts.

FIG. 1 is an isometric view of the present invention mounted on a trailer 39. The preferred embodiment of the invention is depicted in block diagram form in FIG. 2 to show the basic components and the manner in which they are connected to each other. FIG. 3 depicts the parts of the male 34 and female parts 48,49 of the manual coupler which connects the boiler 6 to either the ground heater hose 44 or the pressure washer hose 45.

The components of the preferred embodiment are mounted on a symmetrical rectangular steel skid or platform 38 approximately 90 inches long, 48 inches wide and 6 inches high with sufficient structural strength to hold the components firmly in place. Such a skid functions as the bed 38 of the trailer 39 shown in FIG, 2. A tongue 40 configured for attachment to a hitch on a car or truck (not shown) is preferably bolted to one end of the skid 38 and tandem axles (not shown) with 4 16 inch wheels and trailer tires (only two of four shown as 41*a*, 41*b*) are affixed underneath the skid 38. Fenders (only one 42 shown) are preferably bolted on each side of the skid 38 over the wheels 41*a*,41*b*).

A 10 HP, YANMAR diesel engine 1 connected to a 115 V, 2.5 KW electric generator 2 and a belt driven positive displacement pump (CAT) 3 capable of pumping 4 gallons per minute at 3000 psi is bolted inside one end of a protective steel roll cage 43. The engine 1 can be started with a battery 25 powered starter 26. The shaft 27 of the engine 1 is connected to both the shaft 29 of the pump 3 and the shaft 28 of the generator 2 by belts 30 and 31.

A diesel-fired burner 5 with a capacity of 480,000 BTUs and a 3 gallons of fuel per hour rating is connected to a water tube boiler 6. Hot air from the burner 5 passing over the coiled tube 15 inside the boiler 6 can heat water circulating through the tube 15. The burner 5 and boiler 6 combination is preferably affixed inside the top half of the cage 43 opposite the engine 1 with the connections shown. The pump 3 is connected to the inlet side of coiled tube 15 in the boiler 6 using flexible tubing 47. As described above, the generator 2 has sufficient capacity not only to operate the burner 5 but also a motorized hose reel 9 and auxiliary equipment such as power tools and lights (not shown) as well.

A manual coupler consisting of male 34 and female 48,49 parts is employed at the outlet of the boiler 6 permitting the operator of the equipment to connect either the ground heater hose 44 or the pressure washer hose 45 to the tube in the boiler 6. A manual coupler is preferred because it is better adapted to the high pressures employed for pressure washer use than available commercial valves can withstand.

This entire subassembly of cage, engine, pump, bumer, boiler and generator mounted on either a skid or a trailer as described above can be obtained from HYDRO TEK Systems, Inc. of Redlands, Calif.

To obtain maximum fuel capacity one end of a diesel fuel tank 7 with a length of 60 inches, a width of 40 inches and a depth of 6 inches is preferably mounted underneath the boiler 6 and extends all the way to the opposite end of the skid 38. Such a tank 7 would hold 100 gallons of fuel and last for several days of run time to operate the equipment for ground heater use. Global Power Components of West Allis, Wis., is a suitable source for such a fuel tank.

A plastic (e.g., polyethylene) water tank 8 with a capacity of 190 gallons for ground heater use is mounted on the center of the skid 38. 110 gallons of propylene glycol is added to the tank 8 to prevent freezing during the winter months. A separate float tank 32 with a capacity of 3 gallons is mounted under the boiler 6 for pressure washer use, especially during the winter months. Suitable tanks can be obtained from Hydro Tek Systems, Inc. of Redlands, Calif.

The water tank 8 and the float tank 32 are separately connected to each of the two inlets on a three-way ball valve 33 using flexible tubing 47. The outlet of the valve 33 is connected to the pump 3 using the same tubing 47. The valve 33 can be adjusted manually to allow water to flow from either the main water tank 8 or the float tank 32 depending on the operator's decision to use the equipment for ground heater or pressure washer use. When used as a pressure washer, especially in the winter months, the inlet to the float tank 32 can be connected to an outside source of water using an ordinary water hose. The float in float tank 32 functions much like the ball cock in a toilet tank to regulate the flow of water through the tank, turning on the water from the outside source when the ball sinks with the water level in the tank 32 and turning off the water when the ball rises to the preset level in the tank 32.

A 115 volt electric powered hose reel 9 large enough to store 2500 feet of ground heater hose 44, preferably obtained from Nordic Systems, Inc. of Mississauga, Ontario, Canada, is mounted on the end of the skid 38 opposite the engine 1. A foot switch (not shown) is preferably added to turn the reel motor on or off. The preferred hydronic heat transfer ⅝ inch hose 44, which is capable of withstanding 150 psi working pressure and 850 psi burst pressure and transferring heat 30% faster than other ground heating systems, can be obtained from ParkerHannifin Corp. of Otsego, Mich.

The fuel tank 7 is connected to the burner 5 and the engine 1 using an SAE approved fuel line 46. Using pulleys and belts 29,30 the shaft 27 of the engine 1 is connected to the generator 2 and the pump 3. Flexible tubing 47 is used to connect the water tank 8 to the pump 3 and the pump 3 to the coiled tube 15 in the boiler 6. Thus the water pump 3 can pump water from the water tank 8 through the coiled tube 15 in the boiler 6 through a manually operated coupler 34 to either the ground heater hose 44 or the pressure washer hose 45.

A separate, smaller hose reel 10 with a shorter high-pressure wire braid hose 45 capable of withstanding 3000 psi working pressure and 12000 psi burst pressure is mounted on the end of the skid 38 next to the ground heater hose reel 9. The same hose is used to connect this reel 10 manually to the boiler 6. The pressure washer hose reel 10 is operated manually to extend or retract the pressure washer hose 45. Especially during the winter months an ordinary garden hose (not shown) can be used to obtain water from an outside source for pressure washer use. A wand 12 with a high-pressure nozzle is added to the open end of pressure washer hose 45.

Water is pumped into the ground heater hose 44 at approximately 180 degrees Fahrenheit and returned to the water tank 8 at approximately 150 degrees Fahrenheit Water in the water tank 8 can then be recycled back through the boiler 6 for heating back up to 180 degrees and returning to the ground heater hose 44. Water pumped into the pressure washer hose 45 passes through a triggered wand 12 having a high pressure nozzle on its open end and, after performing its washing task, into the ground.

The ground heater hose 44 is preferably 2500 feet long and when spread snakelike over the ground can heat and thaw 11,000 square feet of ground. The same hose can heat or cure 22,000 square feet of concrete. The ground heater hose 44 is spread approximately 2 feet apart for ground heating and 4 feet apart for curing concrete. The ground heater hose 44 can be broken up into 500 feet segments if desired to cover small areas of ground or concrete using manifolds 36, 37 on the ground heater hose reel 9 with connections that permit the water to flow separately out and back through each segment much like it does when using the entire length of hose 46.

A relief valve 18 is preferably spliced into the flexible tubing 47 between the pump 3 and the coils 15 inside the boiler 6. In the event the ground heater hose 44 is accidentally pinched the valve 35 would be set to react to the resulting increased back pressure to divert the water flowing from the pump 3 to the water tank 8 instead through the boiler 6 to the ground heater hose 44 thereby damaging the latter due to the high pressures that can otherwise result A control panel 4 is preferably mounted on the front surface of the cage 43 enclosing the engine 1, pump 3, generator 2, burner 5, float tank 32 and boiler 6 combination. A battery 25 powered starter 26 is preferably used to start the engine 1 and can be activated from the control panel 4. Separate electrical outlets (not shown) can also be provided preferably on the control panel 4 to supply electricity to auxiliary equipment such as lights if desired. Properly insulated electric wires 13, 23, 24 capable of handling the voltage generated by the generator 2 safely are used to connect the generator 2 to the control panel 4 and thence to burner 5, ground heater hose reel motor 22 and when appropriate to the space heater 11 fan motor.

The components of the present invention can be mounted on the same skid 38 without a tongue 40 or tandem axle with wheels 41*a*,41*b* and fenders 42. The skid 38 can then be loaded onto the bed of a pickup or flatbed truck and transported and used in that configuration.

The ground heater hose 44 can be connected to a space heater 11 using hose 20 to heat rooms or buildings at building sites preferably after use of the water to heat the ground or concrete to take advantage of the 150 degree Fahrenheit water before returning the water back to the water tank 8 using hoses 21 and 19. Use of the electric generating capacity of the equipment can also be employed to operate any equipment requiring electrical power including the fan in the space heater 11, submersible pumps, saws, power tools, unit heaters and lights to illuminate a building site. Such uses add materially to the usefulness of the combination of the present invention without material added expense.

In summer months the large ground heater hose reel 9 can be replaced with another water tank to increase the on-site pressure washer capacity of the invention. In winter months it is more advantageous to rely on an outside source of water to operate the pressure washer since it is not feasible to store plain water without antifreeze, a combination that is not suitable for pressure washer use.

Although an open trailer 39 is described above, an enclosed trailer can also be used with the combination of the present invention. Likewise a gasoline engine and a diesel burner can be employed with separate tanks for gasoline and diesel fuel. A diesel engine is preferred because it eliminates frequent oil changes. An all diesel system is preferred because it eliminates the possibility of damaging either a diesel burner or a gasoline engine if the wrong fuel is placed in the tank that fuels those engines. Alternatively an all propane system is preferred for use in food production plants.

The products disclosed herein represent preferred embodiments of the invention. Many other variations are possible but are too numerous to disclose in their entirety. The words and drawings used and disclosed herein are merely descriptive and illustrative and not intended as exact representations of, or inflexible limitations on, the spirit and scope of the invention disclosed herein. The invention can only be measure by the legally valid scope of any claims eventually issued in a subsequent patent.

What is claimed is:

1. A combination capable of functioning as a ground heater and a pressure washer comprising a fuel tank, an internal combustion engine, a generator, a pump, a water tank, a float tank, a burner, a water-tube boiler, a ground heater hose, a pressure washer hose, an electrically powered reel for the ground heater hose, a manually operated reel for the pressure washer hose, and a control panel wherein the fuel tank is adapted to provide fuel to operate the engine and the burner;

the engine is adapted to supply power to the generator and the pump;

the generator is adapted to generate and deliver electricity to the burner and the ground heater hose reel;

the pump has sufficient capacity and is adapted to deliver water from the water tank or the float tank to the boiler and thence to either the ground heater hose or the pressure washer hose;

the water tank and the float tank are adapted to store and supply water selectively to the pump in sufficient quantity for ground heater or pressure washer use;

the burner has sufficient capacity for ground heater use and is adapted to supply radiant heat to the boiler;

the float tank is adapted to modulate water obtained from an outside source;

the boiler is adapted to provide coiled tubing through which water can be circulated and heated by radiant heat circulated over the tubing by the burner and thence to either the ground heater hose or the pressure washer hose separately;

the powered ground heater hose reel is adapted to store, extend and retract the ground heater hose;

the manually operated reel is adapted to store, extend and retract the pressure washer hose;

the ground heater hose is adapted for ground heater use;

the pressure washer hose is adapted for pressure washer use; and the control panel is adapted to receive electrical power from the generator to control the burner and the motor for the ground heater hose reel.

2. The combination of claim 1 further comprising a three way valve having inlet one, inlet two and an outlet wherein inlet one is connected to the water tank, inlet two is connected to the float tank, and the outlet is connected to the pump to permit water to flow selectively from either the water tank or the float tank to the pump.

3. The combination of claim 2 further comprising a manual coupler adapted to connect the tubing in the boiler to either the ground heater hose or the pressure washer hose.

4. The combination of claim 1 further comprising a diesel fuel tank, a diesel engine and a diesel burner.

5. The combination of claim 4 further comprising a sub-combination of a gasoline engine, a diesel burner, a gasoline fuel tank for the gasoline engine, and a diesel fuel tank for the diesel burner replacing the combination of the exclusively diesel fuel tank, engine and burner specified in claim 4.

6. The combination of claim 1 further comprising a positive displacement pump.

7. The combination of claim 1 mounted on a skid.

8. The combination of claim 1 mounted on a trailer.

9. The combination of claim 1 further comprising a ground heater hose broken up into segments and manifolds mounted on the ground heater hose reel adapted to direct water out and back to more than one segment of ground heater hose at a time.

10. The combination of claim 1 further comprising a space heater adapted to heat enclosed spaces such as rooms and buildings using residual heat in the water after the heated water has passed through the ground heater hose to heat the ground or concrete.

11. The combination of claim 1 further comprising a relief valve located between the pump and the burner adapted to direct water back to the water tank in the event back pressure is built up to a preset level below the burst pressure of the ground heater hose due to an obstruction in the ground heater hose.

12. A combination mounted on a trailer capable of functioning as a ground heater and a pressure washer comprising a diesel fuel tank, a diesel engine, a generator, a positive displacement pump, a water tank, a float tank, a diesel burner, a water tube boiler, a relief valve, a hose adapted for use as a ground heater, a hose adapted for use as a pressure washer, an electrically powered reel for the ground heater hose, a manually operated reel for the pressure washer hose and a control panel wherein the fuel tank is adapted to provide fuel to operate the engine and the burner;

the engine is adapted to supply power to the generator and the pump;

the generator is adapted to generate and deliver electricity to the burner and the ground heater hose reel;

the pump has sufficient capacity and is adapted to deliver water from either the water tank or the float tank to the boiler and thence to the ground heater hose or the pressure washer hose;

the water tank and the float tank are adapted to store and supply water selectively to the pump through a three way valve;

the burner has sufficient capacity for ground heater use and is adapted to supply radiant heat to the boiler, the float tank is adapted to modulate the flow of water obtained from an outside source;

the boiler has sufficient capacity for ground heater use and is adapted to provide coiled tubing through which water can be circulated and heated by radiant heat circulated over the tubing by the burner and thence to either the ground heater hose or the pressure washer hose separately through a manual coupler;

the relief valve is located between the pump and the burner and is adapted to direct water back to the water tank in the event back pressure is built up to a preset level below the burst pressure of ground heater hose due to an obstruction inadvertently encountered in the ground heater hose;

the powered ground heater hose reel is adapted to store, extend and retract the ground heater hose;

the manually operated reel is adapted to store, extend and retract the pressure washer hose;

the ground heater hose is adapted to withstand heat and wear and tear encountered in ground heater use;

the pressure washer hose is adapted to withstand high pressures encountered in pressure washer use; and the control panel is adapted to direct electrical power received from the generator to control the burner and the powered ground heater hose reel.

13. In a combination capable of functioning as a ground heater and a pressure washer comprising a pump, a power source capable of powering the pump, a holding tank capable of storing sufficient liquid for ground heating purposes, a float tank capable of modulating water obtained from an outside source, a heating system for the liquid, a three way valve, a coupler, a hose adapted for ground heater use, and a hose adapted for pressure washer use wherein the overall combination is adapted to enable liquid to flow from either the float tank or the holding tank through the three way valve to the powered pump which is adapted to pump the liquid through the heating system to the coupler and finally to either hose for ground heating use or the pressure washer hose for pressure washer use.

* * * * *